US006209534B1

(12) United States Patent
Taplan

(10) Patent No.: US 6,209,534 B1
(45) Date of Patent: Apr. 3, 2001

(54) COOKING DEVICE WITH A GAS BURNER MOUNTED IN A GLASS-CERAMIC MOLDED BODY

(75) Inventor: Martin Taplan, Rheinboellen (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/277,566

(22) Filed: Mar. 26, 1999

(30) Foreign Application Priority Data

Mar. 27, 1998 (DE) ..... 198 13 691

(51) Int. Cl.[7] ..... F24C 3/00

(52) U.S. Cl. ..... 126/39 R; 126/39 B; 126/214 R; 126/214 A

(58) Field of Search ..... 126/39 R, 40, 126/42, 214 A, 214 R, 215, 221, 39 B, 39 H, 39 K; 99/372, 426, 430

(56) References Cited

U.S. PATENT DOCUMENTS

| | | | | |
|---|---|---|---|---|
| 3,773,027 | * | 11/1973 | Dodd | 126/39 R |
| 5,046,477 | * | 9/1991 | Bennett et al. | 126/39 R |
| 5,186,158 | * | 2/1993 | Ferlin | 126/39 R |
| 5,295,476 | * | 3/1994 | Herbert | 126/39 R |
| 5,313,929 | * | 5/1994 | Thurk et al. | 126/39 R |
| 5,549,100 | * | 8/1996 | Heisner et al. | 126/214 A |
| 5,813,395 | * | 9/1998 | Taplan et al. | 126/214 A |
| 5,931,152 | * | 8/1999 | Fafet et al. | 126/39 R |

FOREIGN PATENT DOCUMENTS

| | | |
|---|---|---|
| 387 647 | 2/1989 | (AT) . |
| 43 33 334 C2 | 10/1996 | (DE) . |
| 0 536 619 B1 | 3/1995 | (EP) . |
| 2 697 320 | 4/1994 | (FR) . |
| WO 91/09255 | 6/1991 | (WO) . |
| WO 97/00407 | 1/1997 | (WO) . |

* cited by examiner

*Primary Examiner*—Ira S. Lazarus
*Assistant Examiner*—Josiah C. Cocks
(74) *Attorney, Agent, or Firm*—Michael J. Striker

(57) ABSTRACT

The cooking device includes a glass-ceramic molded body (2) providing a cooking surface. The glass-ceramic molded body (2) includes a closed or an open upwardly projecting portion (3,13) that, together with a glass-ceramic cover (11) that fits over it, forms a gas/air mixing chamber (5) of a gas burner. The glass-ceramic cover (11) together with either a concave upper surface of the molded body (2) surrounded by the closed upwardly projecting portion or together with a burner section inserted in the open upwardly projecting portion, bounds the mixing chamber (5). Either the cover (11) or an upper edge region of the closed upwardly projecting portion (3) or an upper edge of a burner section (14) mounted in the open upwardly projecting portion (13) is provided with a plurality of circumferentially distributed slots or openings (10) providing channels or ducts for passage of the gas/air mixture from the mixing chamber (5) to a region outside of the mixing chamber (5), in order to burn the gas/air mixture outside the mixing chamber (5).

4 Claims, 3 Drawing Sheets

COOKING DEVICE WITH A GAS BURNER MOUNTED IN A GLASS-CERAMIC MOLDED BODY

BACKGROUND OF THE INVENTION

The present invention relates to a cooking device with at least one gas burner and a flat, plate-like molded body providing a cooking device surface surrounding the at least one gas burner. The molded body is made from a glass-ceramic material or another heat-resistant material with a low thermal expansion coefficient, such as a special glass or ceramic material. The cooking device surface covers the cooking device. Components or operating parts of each gas burner are arranged in the vicinity of an opening provided in the molded body assigned to the respective burner under, over or in the principal plane of the molded body and the gas burners are supported by the molded body.

Gas or gas/electric ranges, the so-called mixed range with a glass-ceramic cooking device surface have been on the market for several years. These cooking units are operated with atmospheric gas burners, as found in the most common design in standard stainless steel or steel cooking units for many years.

Gas ranges with glass-ceramic cooking device surfaces are widely used particularly because of the aesthetic features and ease of cleaning of the glass-ceramic surface, which, e.g. can also be used as a work surface. The incorporation of a metallic gas burner in the currently known design of this type has been found to be disadvantageous because of these consumer motivations. The entire appearance of the cooking apparatus and especially the ability to clean it is poor in the area where the atmospheric gas burner is connected with the gas-ceramic cooking device surface. Furthermore often very expensive connection techniques are required for incorporation of the gas burner, so that the burner is unobjectionable and is connected with the glass-ceramic cooking device surface in a liquid-tight manner. The known assembly systems are very time consuming and expensive.

A burner apparatus is described in European Patent EP 0 536 619 B1, which is known for use with cooking devices, in which at least one gas burner is mounted in a supporting frame and the surrounding surface around the gas burner or gas burners is covered by means of a molded body made from a brittle material, such as glass, glass-ceramic or ceramic material. Each gas burner in this apparatus extends through an opening in the molded body made of brittle material until above its surface. The gas burner or burners is or are supported by the molded body made from the brittle material and a permanent elastic, flexible connecting and sealing device is arranged between the molded body and each gas burner. This connecting and sealing device has a solid and fluid-tight connecting and sealing element engaging on at least one connecting surface of the gas burner and on an edge region of the opening in the molded body for mounting and at the same time providing a liquid-tight seal of the gas burner in the opening of the molded body for mounting and sealing the gas burner in the opening in the molded body. Securing and retaining devices are provided between the gas burner or burners and the supporting frame, which are operative when the supporting molded body is absent, permitting limited movement related to screw attachment and retaining.

In the gas ranges or cooking devices with burners currently on the market the plate covering the area surrounding the gas burner is provided with substantially larger openings than are required for the respective individual gas burners.

The comparatively wide annular gap between the gas burner and the opening edge must be effectively covered. The resulting seal is only partially successful and is insufficient. Overflowing cooking materials can penetrate between the plate and the gas burner. Frequent cleaning of this device is thus required which often requires partial disassembly.

International Patent Application PCT WO 97/00407 describes a plate for a gas range made from a glass-ceramic material, which has at least one opening for a gas burner and several convex elements, which are distributed around this opening and operate as supporting elements for a cooking vessel, such as a pot, which is to be heated with the help of the burners. The convex elements are themselves essentially parts of the plate.

In the unit described in WO 97/00407 the supporting grate, the so-called pot support, in the transitional region of the gas range around the burners with the open flame to the glass-ceramic plate, which is required with conventional gas ranges with open gas burners, may be omitted. For this purpose according to this WO application several equal height convex portions are distributed around the opening of the burner in the glass-ceramic plate and project above the burner acting as a support for a cooking vessel. They are formed in one-piece with the glass-ceramic plate.

In German Patent DE 43 33 334 C2 a plate made from a glass-ceramic material is provided as a component of the cooking apparatus, in which at least one region of the one-piece plate projects or extends from the main plane of the plate in the form of a truncated conical portion, spherical segment portion or truncated spherical portion, or prismatic portion, tetrahedral portion, pyramidal portion, truncated prismatic portion, truncated tetrahedral portion or truncated pyramidal portion. The principal plane of the one-piece plate can have passages and mounting openings for the gas burner. The purpose of the invention disclosed in DE 43 33 334 C2 is a new operational embodiment of a glass-ceramic plate operating as a cooking field, which can be easily assembled without greatly changing the existing structures and the requirements for additional frame and attachment parts is minimized. DE 43 33 334 C2 does not describe the structure of a specific burner arrangement for a cooking apparatus with gas burners.

SUMMARY OF THE INVENTION

It is an object of the present invention to provide an improved cooking device with a gas burner of the above-described kind for practical use having a completely effective seal between the gas burner and the molded body forming a cooking surface, in which the assembly of this cooking device is easy and economically performed with reduced material and with reduced time consumption.

It is also an object of the present invention to provide a cooking apparatus with a gas burner of the above-described kind that is easier to clean and has improved aesthetic properties in comparison to the known prior art systems.

These objects, and others which will be made more apparent hereinafter, are attained in a cooking device comprising at least one gas burner, each having a plurality of gas burner components or parts, and a molded body surrounding said at least one gas burner, which provides a cooking device top surface, having a principal plane passing through it and made of a glass-ceramic material or of a heat-resistant material having a low thermal expansion coefficient, such as a special glass or ceramic material. Each gas burner is supported by the molded body and the gas burner components or parts are arranged above, under or in the principal plane of the molded body.

According to the invention the molded body is formed in the vicinity of each gas burner so that the molded body directly supports or holds the gas burners or at least one of the gas burner components or parts and/or itself forms at least one of the gas burner components or parts.

Particularly that means that a glass-ceramic molded body providing the cooking device surface or a molded body of another heat-resistant material with a reduced thermal expansion coefficient, such as a special glass, especially quartz glass, ceramic material or sintered ceramic material, can be arranged in the vicinity of the gas burner and because of that an integration of the gas burner in the cooking apparatus necessarily occurs. Because of that a smooth transition from the cooking device surface to the burner area is guaranteed, which is easy to clean, which has pleasing aesthetic properties, which clearly simplifies the assembly of the cooking apparatus and thus leads to cost reductions. In this apparatus according to the invention the particular advantages of the glass-ceramic burner surface are utilized, since no thermal stresses are produced between the heated burner area and the cold cooking device surface region, so that this type of structure is in fact possible. Traditional cooking apparatus with stainless steel or steel covers do not permit this type of structure. The formation of the glass-ceramic body can occur in a known way by vacuum formation, hot pressing, shaping rollers or sintering.

In a special embodiment of the invention the molded body in the vicinity of the burner is shaped to extend from its central or main plane and forms there an open circular truncated conical section, an open spherical segment, an open prismatic portion, an open tetrahedral portion or an open pyramidal portion, on whose upper edge the burner rests and thus is held or supported.

The molded body can be formed to project or extend upwardly or downwardly from its center or main plane.

In a very preferred embodiment of the invention a molded body shaped to form a ring-shaped bulged or projecting portion provides a wall on which the burner directly rests and whose upper edge supports the burner. Inside the upwardly projecting portion of the molded body a space is formed with a base or bottom which forms a mixing chamber together with the burner components or parts, especially together with the cover of the burner. The molded body shaped to form the ring-shaped bulged portion defining the wall can also define the space with a bottom surface that is parallel to the main plane of the molded body, which provides a mixing chamber for gas and air together with a cover from the burner.

According to another embodiment of the invention the molded body, especially the glass-ceramic molded body, can be provided with openings or slots acting as burner channels or ducts in its upper edge facing the burner cover, in the vicinity of the burner. The openings required for gas flow can preferably however also be provided in the form of passages or slots in a separate intervening ring located between the burner cover and the molded body. The intervening ring can be made of metal or ceramic material.

The burner cover can also be formed according to the invention so that it can operate as a pan or pot support at the same time. Furthermore the burner cover can advantageously be made of a glass-ceramic material, which as a result, is easily cleaned and has an aesthetically pleasing appearance.

According to a preferred embodiment of the invention the gas burners are atmospheric burners but also may be gas radiant burners, especially with a burner mat based on ceramic, non-oxidic fiber material and/or a mixture of both types of burner.

In a preferred embodiment of the invention additional elements, e.g. an igniter plug and thermocouple element, are integrated in the molded body, especially the glass-ceramic molded body in the vicinity of the gas burner, in as much as an integration of these elements for temperature measurement and automatic ignition in the circular symmetric burner is not possible.

In an especially preferred embodiment of the invention the molded body has an upwardly projecting circumferential portion, which is a closed truncated conical part, a closed spherical segment part, a closed prismatic part, a closed tetrahedral part, a closed pyramidal part, a closed truncated prismatic part, a closed truncated tetrahedral part, a closed truncated pyramidal part of the molded body. This upwardly projecting portion of the molded body can simultaneously operate as a pot or pan support.

In summary, the advantages of the invention include the following:

- no complicated seals are required between the burners and the glass-ceramic molded body;
- the cleaning of the burners and cooking device surface is simplified, since connectors and edges are eliminated;
- the mounting of components is very economical and simple;
- mounting errors are reduced, since the positions of the burners are clearly defined by the shape and structure of the cooking device surface; and
- all components can be easily disassembled for service and for later recycling.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
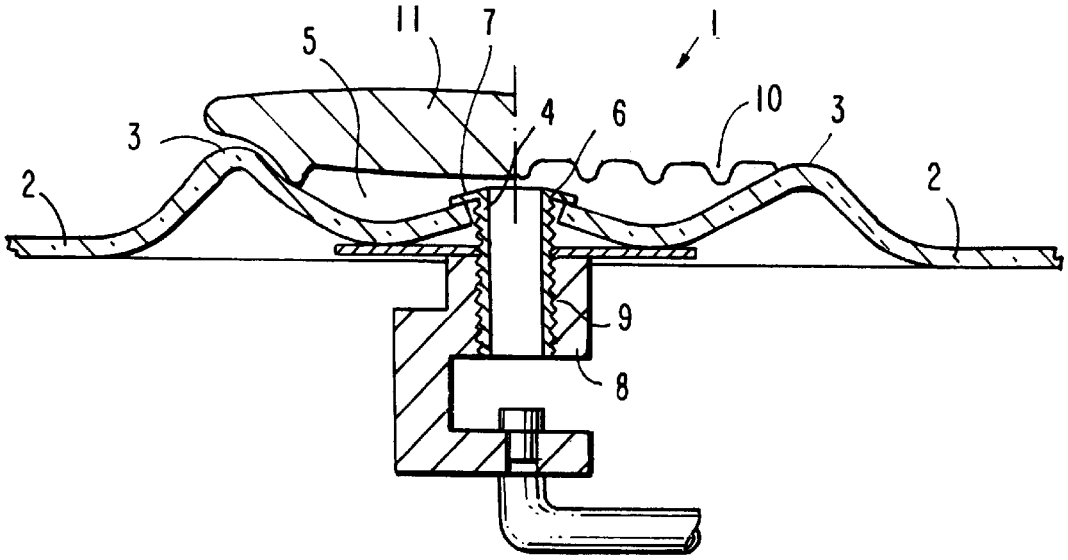
FIG. 1 is a schematic cross-sectional view through a first embodiment of a gas burner according to the invention.

FIG. 1 shows a cross-sectional view of an atmospheric gas burner in which the glass-ceramic molded body 2 is part of the burner 1.

The glass-ceramic molded body 2 has circular symmetric upwardly projecting portion 3 or collar in the vicinity of the burner. The molded body 2 has a convex surface in the vicinity of the collar and then a concave surface so that it is shaped like a volcano. Because of these features of the molded body 2 the upwardly projecting portion 3 in this embodiment is considered to be closed.

A passage 4 is provided in the center. The inwardly extending surface of the glass-ceramic molded body 2 bounds a mixing chamber 5 for mixing the gas/air mixture. The mixture is also assisted by a conical widening of the chamber 5 from the interior to the exterior so that a so-called Venturi effect can occur. A sleeve 6, which is supported with its upper collar 7 on the glass-ceramic molded body 2, is inserted into the central passage 4. The sleeve 6 has an outer thread 9 on its other end on which a nozzle connector 8 can be screwed in the present embodiment. It is also possible to equip the sleeve 6 with a thread in its upper region and then it can be easily attached from above. In that situation the sleeve 6 would be already attached to the nozzle connector 8. In both cases however a connection between the nozzle connector 8 and the sleeve 6 is provided. The upwardly projecting portion 3 of the burner 1 is provided with slot-like recesses or grooves 10. These can be provided immediately during the molding process or however also subsequently by drilling or grinding. Gas flows through these openings 10 to the exterior and burns in a controlled manner. In this case the cover 11 is a simple molded article without additional gas flow or passages 10. Understandably the gas passages or slots 10 can also be integrated in the cover 11 or be provided in an unshown separate intervening ring. In this latter case the burner edge 3 can be planar and no slots 10 are provided. In both cases the burner cover 11 can be an enameled casting, made from aluminum, but in both cases advantageously according to the invention made from glass-ceramic cooking device surface material. In these advantageous embodiments the entire aesthetic properties and particularly the ability to clean the unit are promoted.

Figure 2:
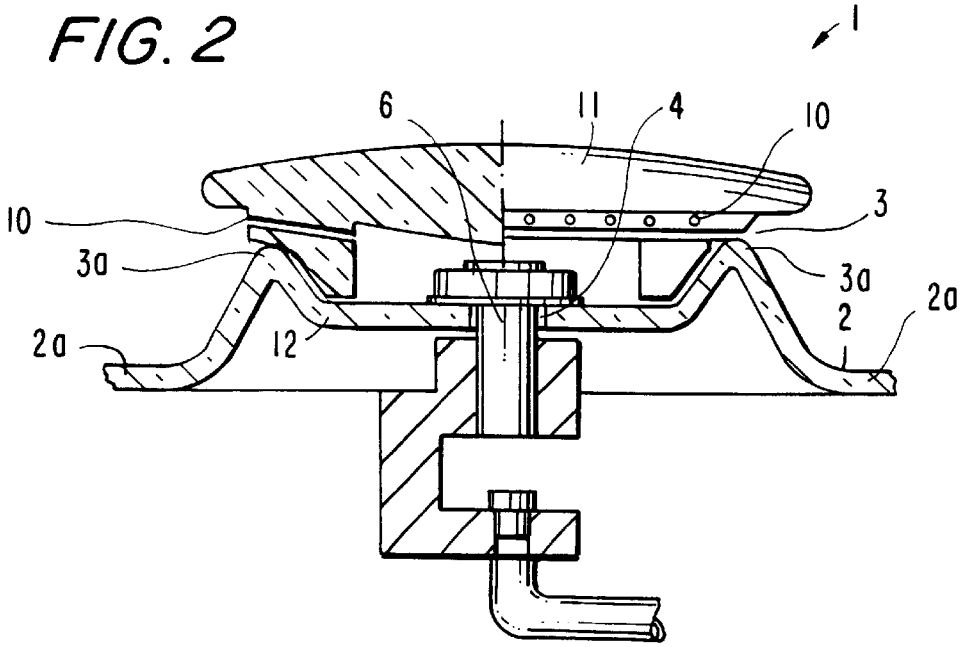
FIG. 2 is a schematic cross-sectional view through a second embodiment of a gas burner according to the invention.

In FIG. 2 a burner structure is shown, which is comparable to that shown in FIG. 1. In the embodiment shown among other things the design of the glass-ceramic molded body 2 is simpler. Here then only a closed raised toroidal upwardly projecting portion 3 is required. The glass-ceramic molded body 2 extends inwardly to the passage 4 in a plane 12 between the cooking device surface plane 2*a* and a plane 3*a* of the closed collar 3. It is also possible to make connections or attachments as in the embodiment of FIG. 1. The Venturi effect is assisted in this case by a suitable shape of the burner cover 11. The gas passages 10 are similarly provided in the burner cover 11. There are many possible choices here for the material used for the burner cover 11. Preferably glass-ceramic material may be used here.

Figure 3:
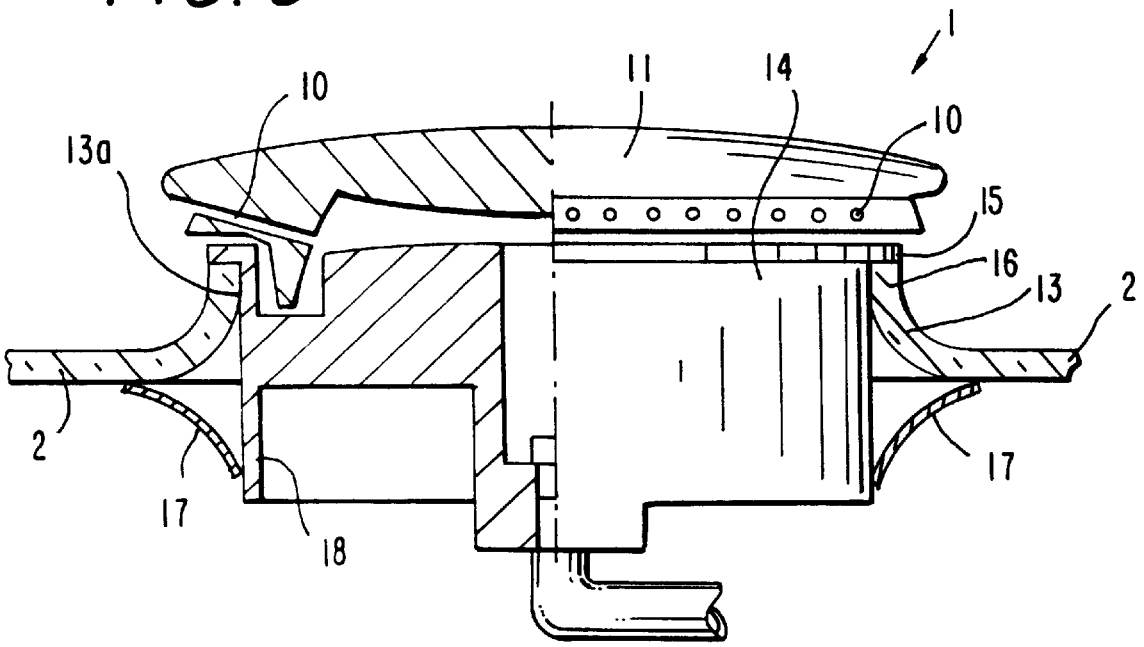
FIG. 3 is a schematic cross-sectional view through a third embodiment of a gas burner according to the invention.

FIG. 3 shows a third embodiment in which the burner edge between the glass-ceramic molded body 2 also providing a cooking surface for the cooking device. The interior burner section 14 is supported by its supporting collar 15 on the upper edge 16 of the open upwardly projecting portion 13, or overlaps it in an unshown manner. The interior burner section 14 can be easily locked or secured on its underside, for example by spring element 17. This spring element 17 can be slipped on from below on the cylindrical burner sleeve 18 and made so a sufficient force-locking connection between the burner wall 13*a* and the burner sleeve 18 is provided. A gap (which is not shown in the figures) between the glass-ceramic molded body 2 and the burner wall 13*a* is provided as a compensation space taking into account the different expansion properties of the glass-ceramic molded body 2 and the metallic burner wall 13*a*. In this case the burner ducts 10 are again integrated into the burner cover 11.

Figure 4:
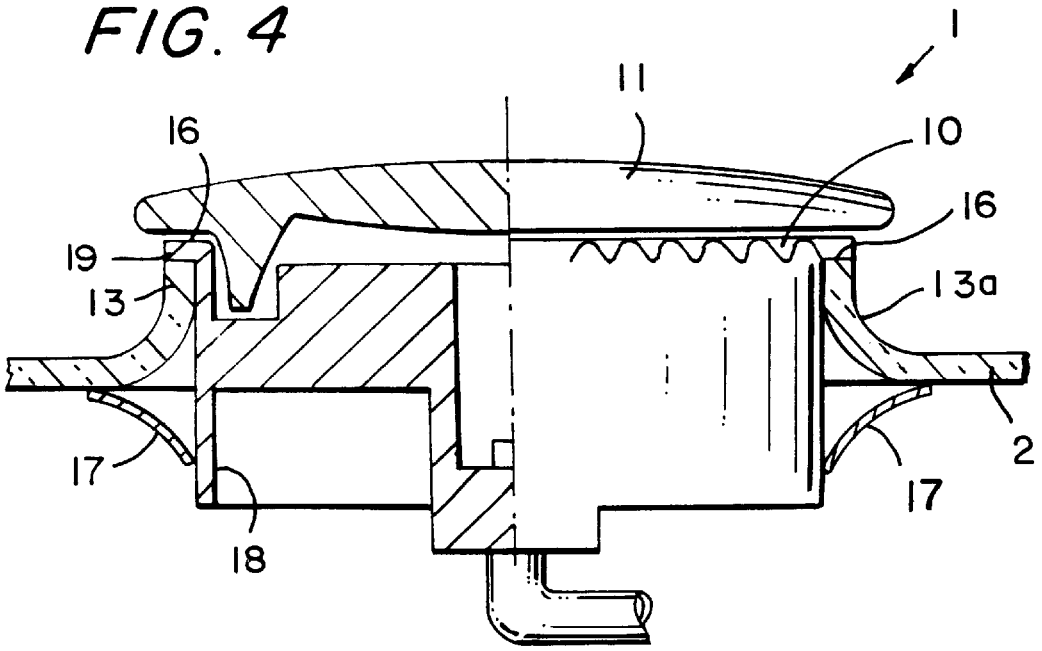
FIG. 4 is a schematic cross-sectional view through a fourth embodiment of a gas burner according to the invention.

The embodiment of FIG. 4 is generally comparable with the embodiment according to FIG. 3. In this case the facing end of the burner wall 13*a* is provided directly with burner slots 10. The collar 19 of the burner sleeve 18 overlaps in this embodiment the upper end of the open upwardly projecting portion 13 only in some parts.

Figure 5:
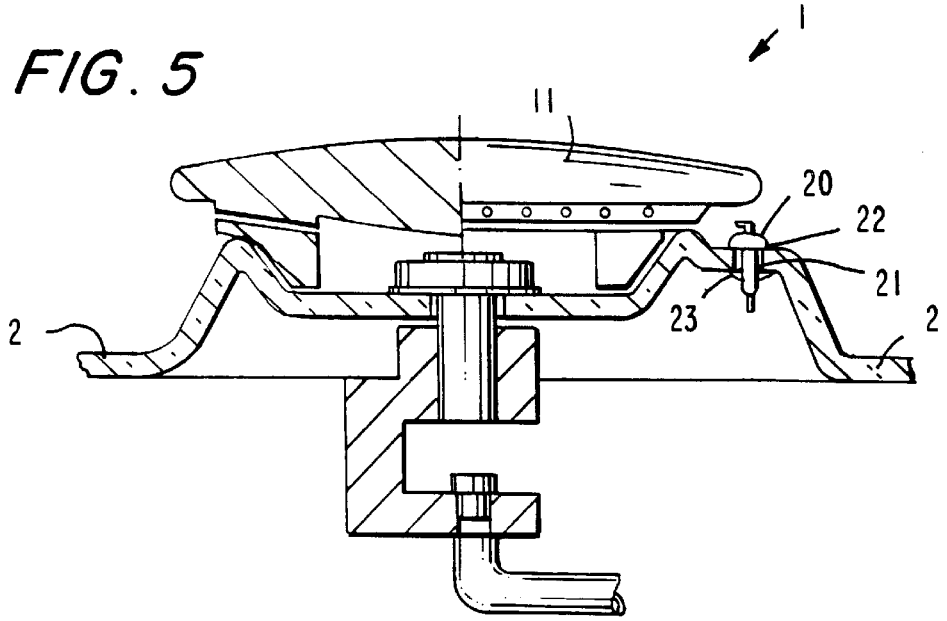
FIG. 5 is a schematic cross-sectional view through a burner according to the invention with an integrated thermocouple element and igniter plug.

FIG. 5 shows the integration of the thermocouple element for temperature monitoring and an igniter plug for automatic ignition. In as much as it is not possible for functional reasons to integrate a thermocouple element for observation of the burner and an igniter plug for automatic ignition in the circular symmetric structure of the burner 1, according to the invention a separate structure in the closed glass-ceramic molded body 2, i.e. a receptacle for these additional elements 20, may be provided. In this case the glass-ceramic molded body 2 is formed as partially shown and is provided with a passage 21 for receiving the thermocouple element or the igniter plug 20. The element 20 can be formed on its upper side for example with a supporting collar 22 and can be attached on the lower side with a tensioning spring 23.

Figure 6:
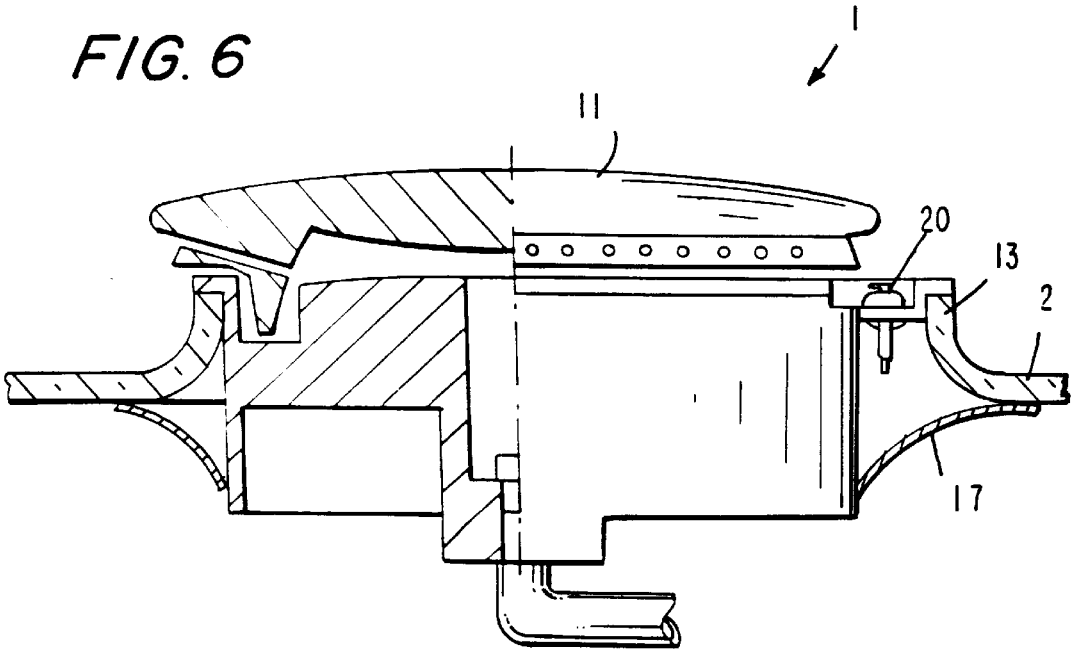
FIG. 6 is a schematic cross-sectional view through another embodiment of the device shown in FIG. 5.

FIG. 6 shows an additional embodiment comparable with FIG. 5 for receiving the igniter plug and a thermocouple element 20. In this case the burner edge supported on the facing edge of the open upwardly projecting portion 13 extends around the thermocouple element or the igniter plug 20 and thus itself integrates the components of the burner.

The term "low thermal expansion coefficient" means a thermal expansion coefficient of the same order of magnitude as that of glass-ceramic material in the following claims.

The disclosure in German Patent Application 198 13 691.9 of Mar. 27, 1998 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a cooking device with a gas burner, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims

What is claimed is:

1. A cooking device comprising a glass-ceramic molded body (2) providing a cooking device surface and including a closed upwardly projecting portion (3,13); and a gas burner comprising the closed upwardly projecting portion (3) surrounding a concave upper surface of the glass-ceramic molded body (2); a glass-ceramic cover (11) fitting on said upwardly projecting portion (3), said glass-ceramic cover (11) forming a mixing chamber (5) for a gas/air mixture together with the concave upper surface of the glass-ceramic molded body (2), and means (6,8) for supplying the gas/air mixture to said mixing chamber (5), wherein either an upper edge region of said closed upwardly projecting portion (3) of said molded body (2) or said cover (11) is provided with a plurality of circumferentially distributed slots or openings (10) providing channels for passage of said gas/air mixture from said mixing chamber (5) to a region outside of said mixing chamber (5), in order to burn said gas/air mixture outside of said mixing chamber (5).

2. The cooking device as defined in claim 1, wherein said glass-ceramic cover (11) is formed as a pan or pot support.

3. The cooking device as defined in claim 1, wherein said closed upwardly projecting portion (3) is a closed truncated conical part, a closed spherical segment part, a closed prismatic part, a closed tetrahedral part or a closed pyramidal part of said molded body.

4. The cooking device as defined in claim 1, further comprising an additional element (20) integrated in said molded body (2) in the vicinity of said gas burner and wherein said additional element (20) is selected from the group consisting of igniter plugs and thermocouple elements.

* * * * *